US005845502A

United States Patent [19]

Chen et al.

[11] Patent Number: 5,845,502

[45] Date of Patent: Dec. 8, 1998

[54] HEAT PUMP HAVING IMPROVED DEFROST SYSTEM

[75] Inventors: Fang C. Chen, Knoxville; Viung C. Mei, Oak Ridge; Richard W. Murphy, Knoxville, all of Tenn.

[73] Assignee: Lockheed Martin Energy Research Corporation, Oak Ridge, Tenn.

[21] Appl. No.: 681,148

[22] Filed: Jul. 22, 1996

[51] Int. Cl.[6] ..... F25D 21/08

[52] U.S. Cl. ..... 62/81; 62/156; 62/275; 62/278

[58] Field of Search ..... 62/156, 160, 151, 62/275, 276, 278, 324.5, 80, 81; 165/240, 241, 242

[56] References Cited

U.S. PATENT DOCUMENTS

| | | | |
|---|---|---|---|
| 2,245,833 | 9/1941 | Chen et al. | 62/113 |
| 3,071,935 | 1/1963 | Kapeker | 62/275 X |
| 4,027,497 | 6/1977 | Thurman | 62/275 X |

*Primary Examiner*—Harry B. Tanner
*Attorney, Agent, or Firm*—Joseph A. Marasco

[57] ABSTRACT

A heat pump system includes, in an operable relationship for transferring heat between an exterior atmosphere and an interior atmosphere via a fluid refrigerant: a compressor; an interior heat exchanger; an exterior heat exchanger; an accumulator; and means for heating the accumulator in order to defrost the exterior heat exchanger.

16 Claims, 2 Drawing Sheets

HEAT PUMP HAVING IMPROVED DEFROST SYSTEM

PUMP HAVING IMPROVED DEFROST SYSTEM

The United States Government has rights in this invention pursuant to contract no. DE-AC05-84OR21400 between the United States Department of Energy and Lockheed Martin Energy Systems, Inc., and also pursuant to contract no. DE-AC05-96OR22464 between the United States Department of Energy and Lockheed Martin Energy Research Corporation.

FIELD OF THE INVENTION

The present invention relates to heat pumps having cyclic defrost systems, and more particularly to such heat pumps which employ a means for reducing the frequency, duration, and energy consumption of the defrost cycles while increasing interior (indoor) thermal comfort.

BACKGROUND OF THE INVENTION

Heat pumps are well known and used for heating and/or cooling enclosures such as buildings and the like. A heat pump generally includes a heat exchanger fluid (usually called a refrigerant) which is circulated between an interior heat exchanger inside the enclosure and an exterior heat exchanger outside the enclosure.

During normal heating mode operation of a heat pump, the exterior heat exchanger thereof becomes colder than exterior ambient and absorbs heat therefrom, and the interior heat exchanger becomes warmer than interior ambient, transferring heat thereto. Thus, heat is "pumped" from a cooler exterior ambient into an interior ambient.

When the exterior temperature is near or below the freezing point of water, ice (frost) usually builds up on the exterior heat exchanger, greatly reducing the heat pump performance. Therefore, defrosting means are generally employed in heat pump systems.

The use of heat pump reversing defrost systems in heat pumps is well known. Such defrost systems are generally designed to melt ice build-up and evaporate water from the exterior heat exchanger in order to minimize deleterious effects of ice on the heat exchange process. Such defrost systems generally activate after a period of heat pump run time, and generally operate until the exterior heat exchanger is raised to a certain temperature to ensure removal of all or at least most ice and water.

During the defrost cycle, the heat pump is generally reversed. The exterior heat exchanger becomes warm, and the interior heat exchanger becomes cold. An auxiliary interior heater (usually an electrical resistance heater or a combustion heater) is energized in order to compensate for the heat absorbed during the defrost cycle by the interior heat exchanger.

In case the heat pump heating capacity cannot meet the house heating load requirement, conventional heat pumps energize the auxiliary resistance heating coil to meet the required load. This can cause a large interior temperature swing, and lowers the efficiency of operation.

OBJECTS OF THE INVENTION

Accordingly, it is an object of the present invention to provide a heat pump having new and improved defrost cycle system.

It is another object of the present invention to provide a heat pump defrost cycle system which significantly reduces the frequency of heat pump reversing.

It is a further object of the present invention to provide a heat pump defrost cycle system which significantly improves interior thermal comfort during the defrost cycle.

It is a further object of the present invention to provide a heat pump defrost cycle system which significantly improves the reliability of the heat pump.

It is a further object of the present invention provide a heat pump defrost cycle system which saves a significant amount of energy during the defrost cycle.

Further and other objects of the present invention will become apparent from the description contained herein.

SUMMARY OF THE INVENTION

In accordance with one aspect of the present invention, the foregoing and other objects are achieved by a heat pump system which includes, in an operable relationship for transferring heat between an exterior atmosphere and an interior atmosphere via a fluid refrigerant: a compressor; an interior heat exchanger; an exterior heat exchanger; an accumulator; and a discrete heating means for heating the fluid refrigerant in order to defrost the exterior heat exchanger, the heat pump being operable in a heating mode for transferring heat from an exterior atmosphere to an interior atmosphere.

In accordance with another aspect of the present invention, a method of heating an enclosure includes the steps of:

a. providing a heat pump system comprising, in an operable relationship for transferring heat between an exterior atmosphere and an interior atmosphere via a fluid refrigerant: a compressor; an interior heat exchanger; an exterior heat exchanger; an accumulator; and a discrete heating means for heating the fluid refrigerant, the heat pump being operable in a heating mode for transferring heat from an exterior atmosphere to an interior atmosphere;

b. operating the heat pump in the heating mode; and, c. energizing the discrete heating means to defrost the exterior heat exchanger in a defrost cycle.

For a better understanding of the present invention, together with other and further objects, advantages and capabilities thereof, reference is made to the following disclosure and appended claims in connection with the above-described drawings.

DETAILED DESCRIPTION OF THE INVENTION

The invention eliminates cool interior air draft during heat a pump defrost cycle, (reducing time required for the defrost cycle) by adding a discrete heating means for heating the fluid refrigerant, usually via the accumulator. Such means is discrete from the heat pump circuit, separately controlled, and can be an electrical resistance heater, any type of combustion heater, or any structure adaptable for applying heat to the accumulator.

Figure 1:
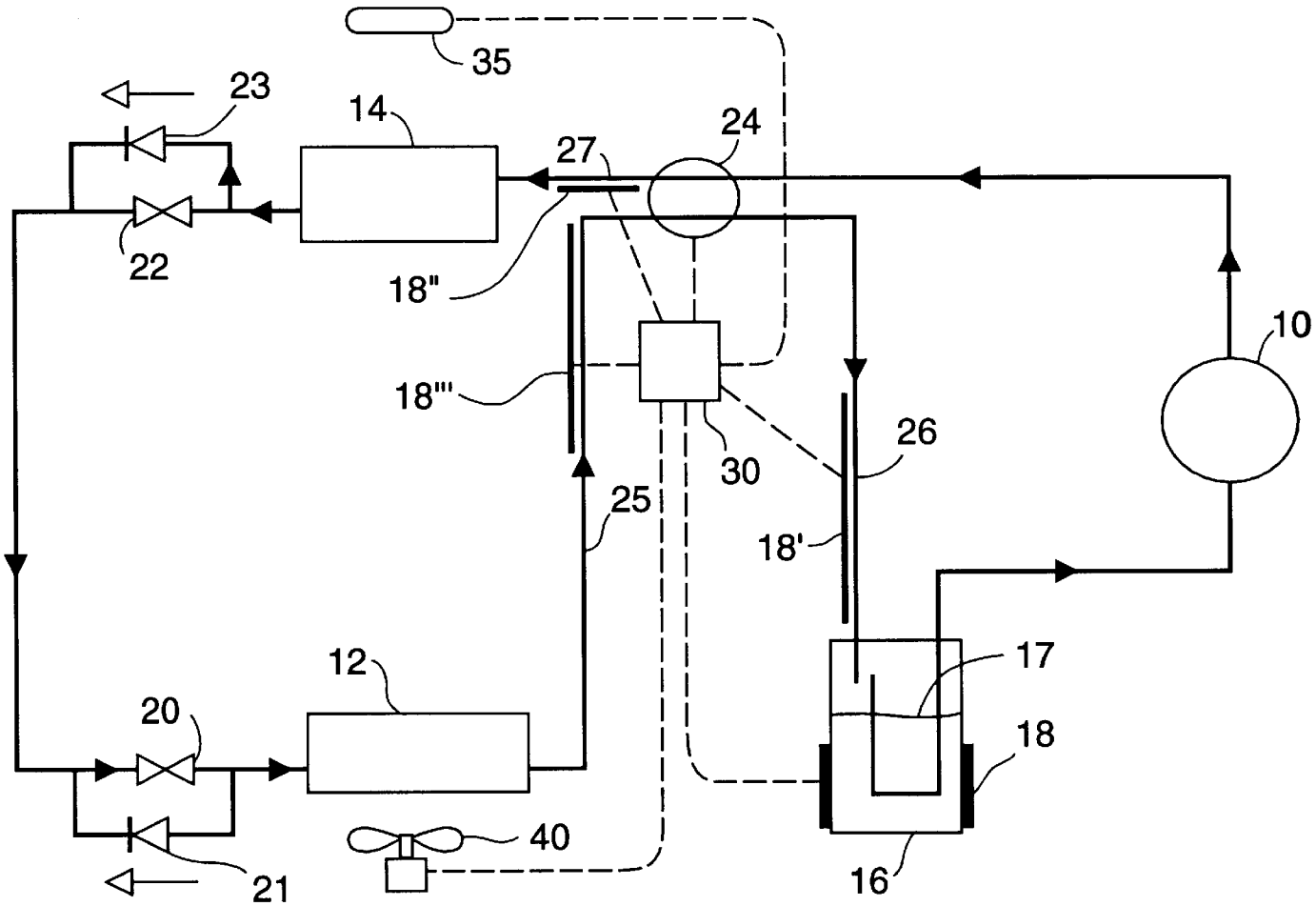
FIG. 1 is a schematic of a heat pump showing circulation in the cooling mode/second defrost cycle, the heat pump having a discrete heating means added to the accumulator and plumbing lines in accordance with the present invention.
Figure 2:
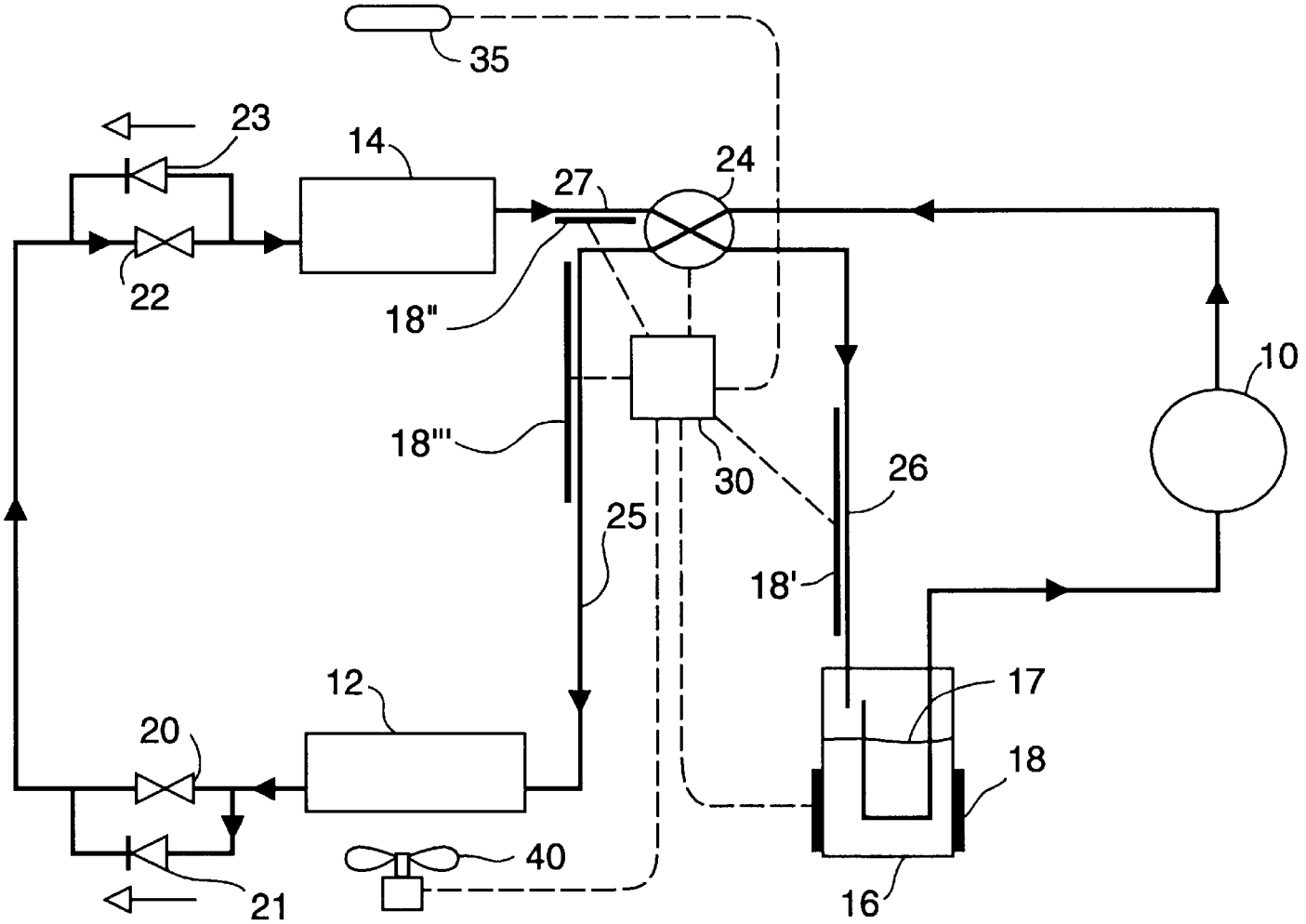
FIG. 2 is a schematic of a heat pump showing circulation in the in the heating mode/first defrost cycle, the heat pump having a discrete heating means added to the accumulator and plumbing lines in accordance with the present invention.

FIGS. 1 and 2 describe essential heat exchange circuits in a heat pump system in accordance with the present invention, showing cooling and heating modes thereof, respectively. Shown therein are: compressor 10, interior heat exchanger 12, exterior heat exchanger 14, accumulator 16 containing liquid refrigerant 17, discrete heating means 18', 18", and/or 18''' for heating the accumulator 16, and/or plumbing lines 25, 26 and/or 27 first and second expansion devices 20, 22, first and second check valves 21, 23, respectively, and heat pump reversing valve 24. Those skilled in the art will understand that complete heat pumps generally further comprise conventional power supplies, various control systems, and various other systems and sub-systems.

Cooling Mode Heat Pump Operation:

Referring now to FIG. 1, heat pump reversing valve 24 is in the cooling mode position so that the interior heat exchanger 12 acts as an evaporator, and the exterior heat exchanger 14 acts as a condenser. Cooling vapor refrigerant flows from the compressor 10 to the exterior heat exchanger 14 to be condensed into hot high pressure liquid. Liquid flows through the second check valve 23 and thence through the first expansion device 20 to be evaporated in the interior heat exchanger 12. The vapor refrigerant flows through the accumulator and returns to the compressor 10 to complete the cycle.

Heating Mode Heat Pump Operation:

Referring now to FIG. 2, heat pump reversing valve 24 is in the heating mode position so that the exterior heat exchanger 14 acts as an evaporator, and the interior heat exchanger 12 acts as a condenser. Cooling vapor refrigerant flows from the compressor 10 to the interior heat exchanger 12 to be condensed into hot high pressure liquid. Liquid flows through the first check valve 21 and thence through the second expansion device 22 to be evaporated in the exterior heat exchanger 14. The vapor refrigerant flows through the accumulator and returns to the compressor 10 to complete the cycle.

Heating Mode/First Defrosting Cycle (FIG. 2)

The invention significantly reduces the frequency of heat pump reversing for defrost. When the exterior heat exchanger 14 needs to be defrosted and the exterior ambient temperature is at least about 32° F. to 36° F., the desired defrosting effect is achieved via the invention without reversing the heat pump.

The minimum exterior ambient temperature for practical operability of such a defrosting cycle depends on at least two factors: 1) the amount of heat applied by the discrete heating means relative to the capacity of the heat pump, and 2) the climate conditions wherein the heat pump is to operate. A preselected minimum exterior ambient temperature in the range of about 32° F. to 36° F. is suggested for residential and commercial heat pumps under normal conditions. A preferable preselected minimum temperature is usually in the range of about 34° F. to 35° F. under normal temperate climate conditions. When the exterior ambient temperature is at or above the preselected minimum exterior ambient temperature, means for controlling heat pump operation, such as a heat pump control system first, causes the following defrost cycle to operate without heat pump reversal. In other words, the heat pump control system maintains the heat pump in the heating mode during the defrost cycle.

Heat is applied, preferably by the heating means 18, to the accumulator 16. Heat can alternatively or additionally be applied to the section 26 of plumbing line between the accumulator 16 and the heat pump reversing valve 24, shown as heating means 18' and/or to the section 27 of plumbing line between the heat pump reversing valve 24 and the exterior heat exchanger 14, shown as heating means 18". Heating means 18 can be an electrical resistance heater or any other conventional device which can be adapted for applying heat to the system as described hereinabove.

Upon application of sufficient heat as described hereinabove, the pressure downstream of the second expansion device 22 (suction pressure) rises, and thus the temperature of the exterior heat exchanger 14 rises to a generally preselected temperature above 32° F. to effect defrosting thereof. Defrosting is thus accomplished while the heat pump is still in heating mode operation.

Since frost is most likely to build on the exterior heat exchanger 14 when the exterior ambient temperature is the range of about 32° F. to 40° F., the above described use of the invention at a minimum preselected temperature as described hereinabove provides a significant increase in over-all efficiency of the heat pump system.

EXAMPLE I

A two-ton air conditioning unit as described hereinabove, charged with R-22 refrigerant was used to test the invention as described hereinabove. Test results indicated that a 1200 BTU/Hr heat input to the accumulator 16 raised the suction pressure by 8 psi, representing an increased exterior heat exchanger 14 temperature by about 6° F.

Application of additional heat via the discrete heating means further raises the exterior heat exchanger 14 temperature. The heat applied as described hereinabove is efficiently utilized as it is delivered to the house through the compressor 10. Because of the raised compressor suction pressure and temperature, the compressor 10 heating capacity increases. With the increased heat pump heating capacity and elimination of heat pump reversing and associated interior cool air draft, interior thermal comfort is improved. Because the frequency of defrost cycle heat pump reversing is reduced, heat pump reliability is improved.

Heating Reversed/Second Defrosting Cycle (FIG. 1)

When the exterior ambient temperature falls below a preselected temperature as described hereinabove, the heating capacity of the heating means may no longer be sufficient to efficiently raise the exterior heat exchanger 14 temperature above 32° F. In this situation, the heat pump control system 30 causes conventional heat pump reversal during the defrost cycle. The refrigerant flow valve 24 is temporarily shifted to the cooling mode position so that the heat pump is operating in reversed mode as described hereinabove. However, the invention is distince from conventional heat pump reversing defrost cycles as is described hereinbelow.

Heat pump reversal can be simultaneous with energizing of heating means 18', 18", and/or 18''' or delayed a short period, whichever is more efficient for a particular application.

The heat required to evaporate the refrigerant is applied, preferably by the heating means 18, to the accumulator 16. Heat can alternatively or additionally be applied to the section 26 of plumbing line between the accumulator 16 and the heat pump reversing valve 24 shown as heating means 18' and/or to the section 25 of plumbing line between the heat pump reversing valve 24 and the interior heat exchanger 12, shown as heating means 18'''. The interior blower 40 is preferably inactivated (turned off) during this type of defrost cycle.

Refrigerant boiling in the accumulator 16 (and/or in the plumbing lines 25 and 26) causes the suction temperature and pressure to increase. The compressor heating capacity therefore increases immediately. This diminishes the need for use of the ubiquitous and conventional resistance type auxiliary heater (not illustrated) except under conditions of very cold exterior ambient temperatures.

During the first two minutes of the defrost cycle, conventional heat pumps generally compress almost all refrigerant into the accumulator because of the heat pump reversing, which results in a "refrigerant-starved" compressor. The effectiveness of defrost cycle is delayed thereby. In contrast, the present invention boils liquid refrigerant in the accumulator (and/or in the plumbing sections 25 and 26) almost immediately, which avoids "refrigerant-starvation" of the compressor, and thus accelerates the defrosting process.

A new liquid over-feeding air conditioning system has been proven to provide increased cooling capacity and coefficient of performance. The system is described in U.S. Pat. No. 5,245,833, issued on Sep. 21, 1993, entitled "Liquid Over-Feeding Air Conditioning System and Method", the entire disclosure of which is incorporated herein by reference. The liquid over-feed principle taught therein can be applied to a preferred embodiment of the heat pump set forth in the present invention. The refrigerant in the system should be charged so that liquid refrigerant is present in the accumulator-heat exchanger, in order to take advantage of the liquid over-feed principle.

The invention described hereinabove can be used in heat pumps with or without liquid over-feed feature. In the preferred liquid over-feed heat pump, the accumulator-heat exchanger 16 generally always contains liquid refrigerant. Adding heat into the accumulator-heat exchanger 16 boils off the refrigerant therein causing an increase in suction pressure.

For conventional (non-liquid over-feed) heat pumps, when frost begins to build on the exterior coil, refrigerant generally begins accumulating in the accumulator. During the defrost cycle, the heat input to the accumulator in accordance with the invention boils refrigerant in the accumulator, causing the suction pressure and temperature to increase, achieving essentially the same results as in the case of the liquid over-feed heat pump.

Some of the advantages of the present invention are:

1. Interior thermal comfort is improved. For conventional heat pump systems during the defrost cycle, even though the interior electric resistance heating coil is on, the temperature of air circulating through the interior air handling system (not illustrated) is still generally only about 65° to 70° F. Persons generally feel cold if such an air draft blows on them. With the present invention, there is no heat pump reversing while the exterior ambient is at least the preselected temperature. The heat pump continues to operate in heating mode while the frost on the exterior heat exchanger 14 coil is being melted. Simultaneously, the heating capacity of the heat pump is increased and the compressor efficiency is improved.

For lower exterior ambient temperatures, the heat pump is reversed as in conventional systems for defrosting. However, the electrical blower on the interior heat exchanger 12 (not illustrated) is usually inactive, eliminating interior cool air draft.

Moreover, in case the heat pump heating capacity is less than the required heating load, such as when the exterior ambient temperature is very low, a conventional heat pump system energizes the interior auxiliary resistance heating coil (not illustrated) to make up the heating capacity needed. Persons generally feel warm when the electric resistance coil is energized and then cold when the resistance coil is de-energized. With the present invention, the heating means 18 provides sufficient heat to the accumulator 16 so that the compressor 10 efficiency is immediately increased and more heat is delivered to the interior. This eliminates most large interior temperature swings and thus improves the interior thermal comfort.

2. Heat pump reliability is increased. It is known that heat pump reversing during defrost cycles imparts large mechanical and electrical stresses to the heat pump system. Because the frequency of defrost cycle heat pump reversing is drastically reduced, the heat pump, particularly the compressor, reliability is improved.

An example can be provided according to data in the *ASHRAE Handbook—Fundamental* 1989, Chapter 28, page 28.11 (American Society of Heating, Refrigerating, and Air Conditioning Engineers, Inc., 1791 Tullie Circle, N.E., Atlanta Ga. 30329). In the Knoxville, Tenn. area, there are an average 1238 hours yearly wherein the exterior ambient temperature is in the range of 37° F. to 42° F., and an average 845 hours below 32° F. For a heat pump which defrosts once every 90 minutes, a total of 1388 time cycle heat pump reverses are required for a conventional heat pump. The present invention eliminates 825 heat pump reverses (about 60%). Such drastic reduction of heat pump reversing improves the heat pump reliability.

3. Energy consumption is reduced. The conventional resistance type auxiliary heater (not illustrated) is not energized during the defrost cycle because the function therein is replaced by the heating means 18. Because the heating means 18 is attached directly to the accumulator 16, the heat transfer between refrigerant and heating coil is direct, and much more efficient than that of interior coil, air and conventional resistance type auxiliary heater. Moreover, because the interior blower 40, is preferably inactive during the second defrosting cycle the fan power is saved as well.

4. The time required for the defrost cycle is significantly shortened. During the defrosting cycle of a conventional heat pump, the heat pump is reversed and liquid refrigerant is pushed into the accumulator, causing "refrigerant starvation" as noted hereinabove. The invention overcomes this disadvantage by applying heat directly to the accumulator to effect immediate boiling of refrigerant in the accumulator 16. The defrost cycle is thus shortened.

The present invention can be implemented in new heat pumps and retrofitted into existing heat pumps with minimum capital cost, involving installation of a heating means 18 and heat pump controls (not illustrated) that can be easily engineered for a particular application and installed therein by those skilled in the art.

The present invention can also be used on refrigeration systems which employ defrost cycles for faster and more energy efficient defrosting thereof.

The present invention is also useful in electric vehicles. The use of heat pumps for providing cab heat in electric vehicles is desirable, but efficient defrost has been a major problem. With the present invention, the cab does not have a cool draft, and energy savings provided thereby would result in extended driving range.

While there has been shown and described what are at present considered the preferred embodiments of the invention, it will be obvious to those skilled in the art that various changes and modifications can be made therein without departing from the scope of the inventions defined by the appended claims.

What is claimed is:

1. A heat pump system comprising, in an operable relationship for transferring heat between an exterior atmosphere and an interior atmosphere via a fluid refrigerant: a compressor; an interior heat exchanger; an exterior heat exchanger; an accumulator; a heat pump reversing valve; and a discrete heating means disposed in heat transferable contact with at least one of said accumulator, a section of plumbing line between said accumulator and said heat pump reversing valve, and a section of plumbing line between said heat pump reversing valve and said exterior heat exchanger for heating said fluid refrigerant to raise suction pressure in order to defrost said exterior heat exchanger during a defrosting cycle wherein said heat pump continues to operate in a heating mode.

2. A heat pump system in accordance with claim 1 wherein said discrete heating means is in heat transferable contact with said accumulator.

3. A heat pump system in accordance with claim 1 further comprising a control means for controlling a defrost cycle to defrost said exterior heat exchanger, said control means comprising an energizing means for energizing said discrete heating means.

4. A heat pump system in accordance with claim 3 wherein said control means includes means for maintaining said heat pump in the heating mode during said defrost cycle when exterior ambient temperature is at least a preselected temperature.

5. A heat pump system in accordance with claim 4 wherein said defrost cycle is a first defrost cycle, and wherein said discrete heating means is disposed in heat transferable contact with at least one of said accumulator, a section of plumbing line between said accumulator and said heat pump reversing valve, and a section of plumbing line between said heat pump reversing valve and said interior heat exchanger for heating said fluid refrigerant to raise suction pressure in order to defrost said exterior heat exchanger during a second defrosting cycle wherein said heat pump operates in a reversed mode when exterior ambient temperature is below said preselected temperature.

6. A heat pump system in accordance with claim 4 wherein said preselected temperature is set to a temperature in the range of about 32° F. to 36° F.

7. A method of heating an enclosure comprising the steps of:

a. providing a heat pump system comprising, in an operable relationship for transferring heat between an exterior atmosphere and an interior atmosphere via a fluid refrigerant: a compressor; an interior heat exchanger; an exterior heat exchanger; an accumulator; a heat pump reversing valve; and a discrete heating means disposed in heat transferable contact with at least one of said accumulator, a section of plumbing line between said accumulator and said heat pump reversing valve, and a section of plumbing line between said heat pump reversing valve and said exterior heat exchanger for heating the fluid refrigerant;

b. operating said heat pump in said heating mode;

c. intermittently operating a defrost cycle comprising maintaining said heat pump in heating mode while energizing said discrete heating means to raise suction pressure in order to defrost said exterior heat exchanger.

8. A method in accordance with claim 7 wherein said energizing step is carried out by transferring heat from said discrete heating means to said accumulator.

9. A method in accordance with claim 7 wherein said energizing step is carried out by a control means for controlling said defrost cycle.

10. A method in accordance with claim 7 energizing step further comprises maintaining said heat pump in the heating mode during said defrost cycle when exterior ambient temperature is at least a preselected temperature.

11. A method in accordance with claim 10 wherein said preselected temperature is set to a temperature in the range of about 32° F. to 36° F.

12. A method of heating an enclosure comprising the steps of:

a. providing a heat pump system comprising, in an operable relationship for transferring heat between an exterior atmosphere and an interior atmosphere via a fluid refrigerant: a compressor; an interior heat exchanger; an exterior heat exchanger; an accumulator; a heat pump reversing valve; and a discrete heating means disposed in heat transferable contact with at least one of said accumulator, a section of plumbing line between said accumulator and said heat pump reversing valve, and a section of plumbing line between said heat pump reversing valve and said interior heat exchanger;

b. operating said heat pump in a heating mode;

c. intermittently operating a defrost cycle comprising reversing said reversing valve and energizing said discrete heating means to raise suction pressure in order to defrost said exterior heat exchanger when exterior ambient temperature is below a preselected temperature.

13. A method in accordance with claim 12 wherein said defrost cycle further comprises inactivating a blower on said interior heat exchanger.

14. A method in accordance with claim 12 wherein said energizing step is carried out by transferring heat from said discrete heating means to said accumulator.

15. A method in accordance with claim 12 wherein said energizing step is carried out by a control means for controlling said defrost cycle.

16. A method in accordance with claim 12 wherein said preselected temperature is set to a temperature in the range of about 32° F. to 36° F.

* * * * *